US006101718A

United States Patent [19]

Zysman

[11] Patent Number: 6,101,718

[45] Date of Patent: Aug. 15, 2000

[54] PROCESS FOR PRODUCING A NEW IMPROVED MATTRESS FROM A USED MATTRESS

[75] Inventor: Simon Zysman, Toronto, Canada

[73] Assignee: American Risk Management Inc., Toronto

[21] Appl. No.: 08/913,154

[22] PCT Filed: Mar. 11, 1996

[86] PCT No.: PCT/CA96/00138

§ 371 Date: Sep. 8, 1997

§ 102(e) Date: Sep. 8, 1997

[87] PCT Pub. No.: WO96/28068

PCT Pub. Date: Sep. 19, 1996

[30] Foreign Application Priority Data

Mar. 13, 1995 [CA] Canada ..... 2144506

[51] Int. Cl.[7] ..... B21D 3/16; B23P 6/00

[52] U.S. Cl. ..... 29/896.92; 29/402.05; 29/402.08; 29/402.21; 29/403.1

[58] Field of Search ..... 29/402.04, 402.21, 29/402.05, 896.9, 402.08, 403.1, 896.92; 5/716

[56] References Cited

U.S. PATENT DOCUMENTS

| | | | |
|---|---|---|---|
| 144,630 | 11/1873 | Peirce | 29/402.21 X |
| 379,573 | 3/1888 | Gillon | 29/896.9 X |
| 401,721 | 4/1889 | Sedgwick | 29/896.9 X |
| 894,428 | 7/1908 | Emery | 29/896.9 X |
| 1,722,389 | 7/1929 | Opie et al. | 29/402.21 X |
| 2,305,711 | 12/1942 | Jones et al. | 29/402.21 X |
| 3,002,865 | 10/1961 | Johnson | 29/896.9 X |
| 3,343,573 | 9/1967 | Dillon | 29/896.9 X |
| 3,711,917 | 1/1973 | Baumgras | 29/896.9 X |
| 4,229,962 | 10/1980 | Tunderman | 29/402.21 X |
| 5,048,167 | 9/1991 | Heffley et al. . | |

FOREIGN PATENT DOCUMENTS 35 05 571 A1 of 0000 Germany .

*Primary Examiner*—David P. Bryant
*Assistant Examiner*—Marc W. Butler

[57] ABSTRACT

The invention relates to an improved mattress comprising an inner spring assembly from a used mattress wherein the inner spring assembly has been stripped of its outer covering of ticking and padding material, heat treated to provide stress relief to the components of the inner spring assembly having received only partial stress relief or no stress relief when the assembly was new, and covered with new ticking and padding material. Prior to the heat treatment, the used inner spring assembly has any bent border wires and connecting wires straightened, and displaced components returned to their proper position, and any damaged components replaced with good quality new or used replacement components resulting in the same inner spring assembly structure as when the assembly was new. The resulting mattress has improved load bearing capacity compared to the original mattress when it was new.

10 Claims, 3 Drawing Sheets

PROCESS FOR PRODUCING A NEW IMPROVED MATTRESS FROM A USED MATTRESS

FILED OF THE INVENTION

This invention relates to the production of new improved inner spring containing products such as mattresses, box springs, cushions or the like from discarded used products of this type.

BACKGROUND OF THE INVENTION

It has been known to take discarded used mattresses which are still in reasonable condition and refurbish same for resale as used mattresses by subjecting same to a sanitizing process which is covered by laws in certain jurisdictions such as California and Pennsylvania.

This sanitizing process includes heating the used mattress to some 110 to 116 degrees Celsius (230 to 240 degrees Fahrenheit) as well as treating same with chemical disinfectants. Such refurbished mattresses can then be sold as used products.

It is also known to refurbish a used mattress by removing the outer ticking and padding material from the inner spring assembly, straightening bent components on the inner spring assembly and then attaching new ticking and padding material to the inner spring assembly. However, the inner spring assembly will have suffered some fatigue from use and, although the refurbishing activity may provide some local improvements within the assembly, on balance the inner spring assembly will have a reduced load bearing capacity than when new. Such refurbished mattresses are therefore inferior to the original mattress when it was new. While they may be returned to their owners, such refurbished matresses cannot be sold to the general public except as product containing used material.

The basic component of most spring filled mattresses is of course the inner spring assembly whose construction has remained essentially unchanged for nearly a century. This inner spring assembly comprises a series of hour glass shaped coils of heavy wire arranged in rows and tied together in their rows by various means such as pigtails or crimp rods formed of much lighter wire than the coils. Border wires tied to the boundary coils surround the inner spring assembly. The inner spring assembly of many box springs is generally similar to that of a mattress except that the coils have an inverted cone shape and, since the assembly is attached at the bottom to a wooden frame, the border wire and connecting wire are only fastened to the top side of the coils.

The components of the inner spring assembly are all made of metal wire which becomes stressed at positions where significant permanent bending of the wire takes place and results in a reduction of the load bearing capacity of the wire at said positions. In a new inner spring assembly, this stressing happens when the wire is formed into a shape such as the hour glass coil or the border wire or when the the wire is bent or wrapped to join the other components as in the case of crimp rods and pigtails. These stresses can be relieved to a greater or lesser extent, depending on the temperature and duration of the heating process, by heating the wire and then allowing the wire to cool in air to room temperature which results in an improvement in the wire's mechanical properties and a corresponding improvement in the load bearing capacity of the inner spring assembly.

By contrast, a minor bending of the border wire, pigtail wire or crimp rods will actually increase the load bearing capacity of these wires at the location of the bend. Accordingly, the minor bending of said wires, which occurs when the mattress is subjected to heavy use, followed by an opposite bending of the same wires to restore their position actually improves the local mechanical properties of said wire.

The individual hour glass shaped coils are normally subjected to a brief and often uneven heat treatment process that partially relieves stresses after their formation. Sometimes the border wires and wire elements tying the spring coils together are not stress relieved. In some instances they are briefly heated to obtain a partial relief of stresses. Because these components are either not stress relieved or only partially stress relieved, the inner spring assembly can be improved by subsequent heat treatments.

In use the inner spring covering of ticking and padding material and the like is subjected to staining, ripping, lumping and tearing. Under normal use, the border wires and connecting wire elements sometimes experience minor bending. Under heavy use, the coil springs may in fact shift out of proper position or, in rare instances, become distorted or broken. However, in most cases, even after long time usage, the load bearing capacity of the individual coils is substantially unimpaired so that a subsequent heat treatment of the inner spring assembly actually improves the load bearing capacity of the individual coils compared to when new.

Moreover because the inner spring assembly is enclosed by the ticking and padding material, it is essentially protected from oxidation which could deleteriously affect the wire members including the hour glass coils.

Recognizing that in most cases the coils of an inner spring assembly remain substantially unimpaired in use even in mattresses that had long time usage coupled with a realization that the quality of metal which has been subject to a partial heat treating stress relieving process can be further improved by subsequent or additional heat treating processes led to the present invention of being able to use the inner spring assembly of used mattresses or similar inner spring containing products to produce new mattresses or similar inner spring containing products having qualities superior to the original products when they were new warranting sale of the products of the present invention as new products.

SUMMARY OF THE INVENTION

According to the present invention which will be described with specific reference to mattresses, the inner spring assembly of a used mattress is removed therefrom and cleaned of all ticking and padding material. Any bent or broken coil spring connector wires or border wires are then straightened or replaced and any displaced coil springs restored to their original position. In the unlikely event of a bent or broken coil, said coil would be replaced.

The inner spring assembly is then subjected to a heat treating process in which it is introduced into an oven and heated to a temperature of the order of 288 degrees Celsius (550 degrees Fahrenheit) for a period of about ten to twenty minutes.

This heat treating process functions not only to provide a further and additional stress relieving of the previously stress relieved coils but provides stress relief in all of the other wire elements as well.

As a result, any new wire elements are stress relieved as well as any of the original wire elements that did not require replacement. Frequently these original wire elements would not have been stress relieved at the time of the original mattress manufacture but even if they were their quality would be improved by the subsequent stress relieving process of the present invention.

Furthermore, any border wires or connecting wires that experienced minor bending away from their normal shape and position through heavy use and were subsequently bent back to their proper position will receive an additional benefit at these twice bent locations beyond that obtained from the stress relief heat treatment.

The result is that the combined improvements from further stress relieving the coils, providing original or further stress relief to the border wire and connecting wire, and the twice bending of localized positions of the border wire and connecting wire results in an inner spring assembly whose overall load bearing capacity is improved compared to when it was new.

The said heating of the inner spring assembly to provide for stress relief takes place at a higher temperature than that required for mere sanitization of the assembly whereby sanitization is automatically effected in the stress relieving process.

Following this stress relieving process, the inner spring assembly is covered with the usual ticking and padding material ready for sale as a mattress having superior qualities to the original mattress from which the inner spring assembly had been taken.

DETAILED DESCRIPTION ACCORDING TO THE PREFERRED EMBODIMENTS OF THE PRESENT INVENTION

Figure 1:
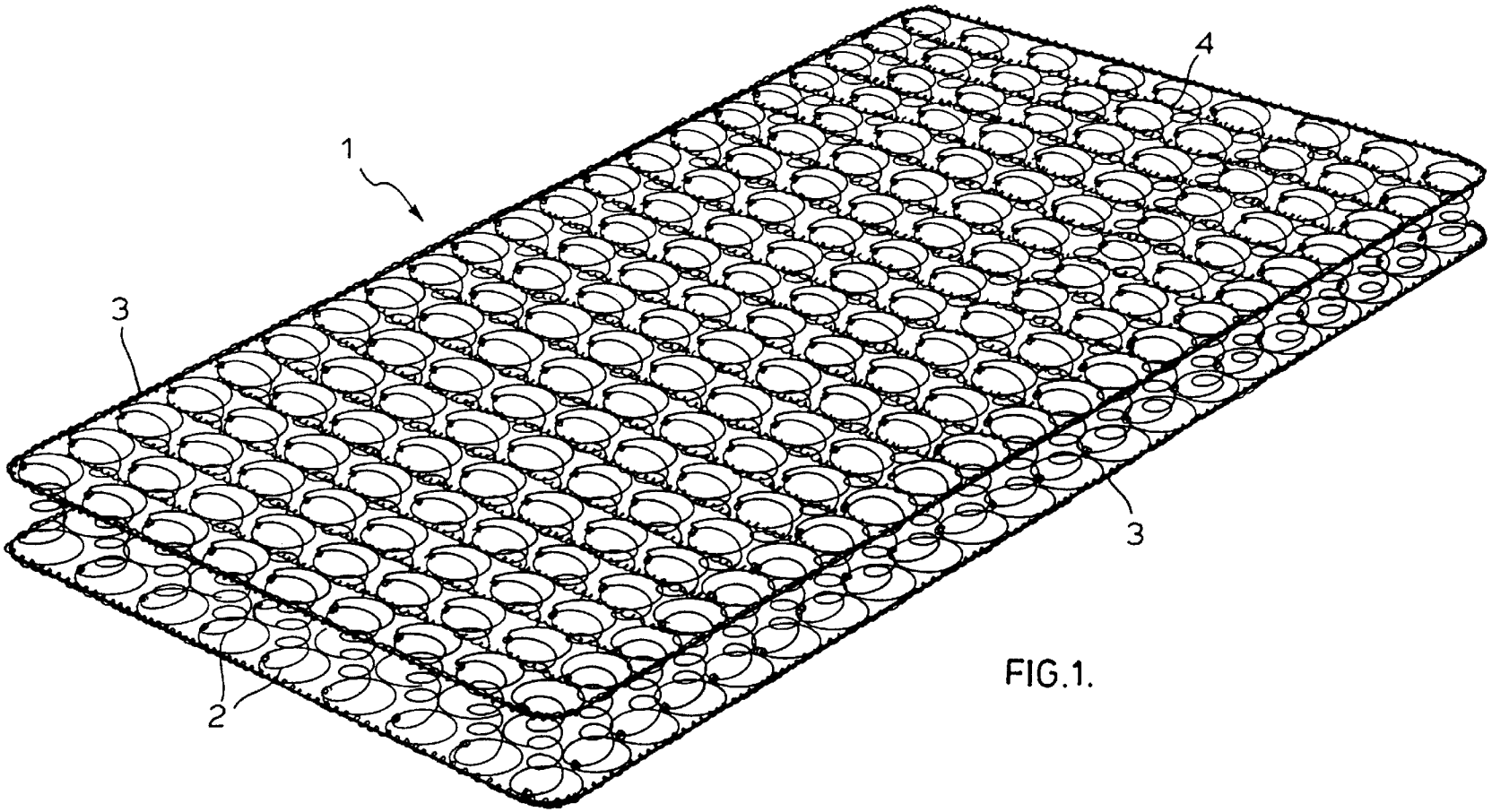
FIG. 1 is a perspective view of an inner spring assembly.
Figure 2:
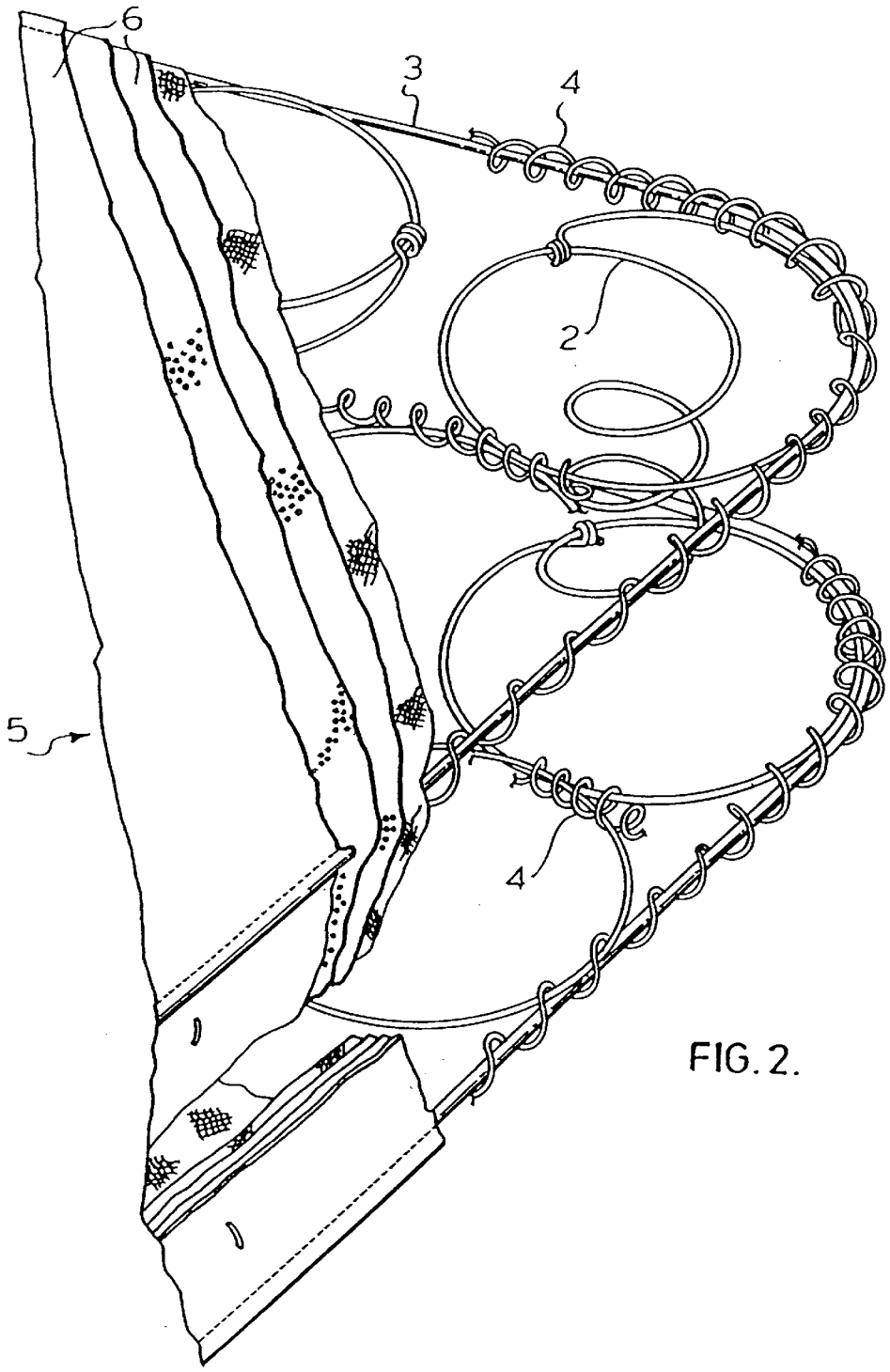
FIG. 2 is a cut away corner view of a mattress.

As shown in FIGS. 1 and 2, an inner spring assembly 1 comprises hour glass coils 2 arranged in a two dimensional array, border wire 3 forming a perimeter around top and bottom surfaces of said array, and pigtail wire 4 wound in a helical fashion along said border wire and between the rows of coils thereby connecting each coil and the border wires to their respective adjacent coils.

A mattress 5 has covering layers 6 attached to the inner spring assembly 1. Said covering layers typically consist of an insulator pad against the inner spring assembly, followed by one or more layers of cushioning material, and an outer layer of ticking material.

Figure 3:
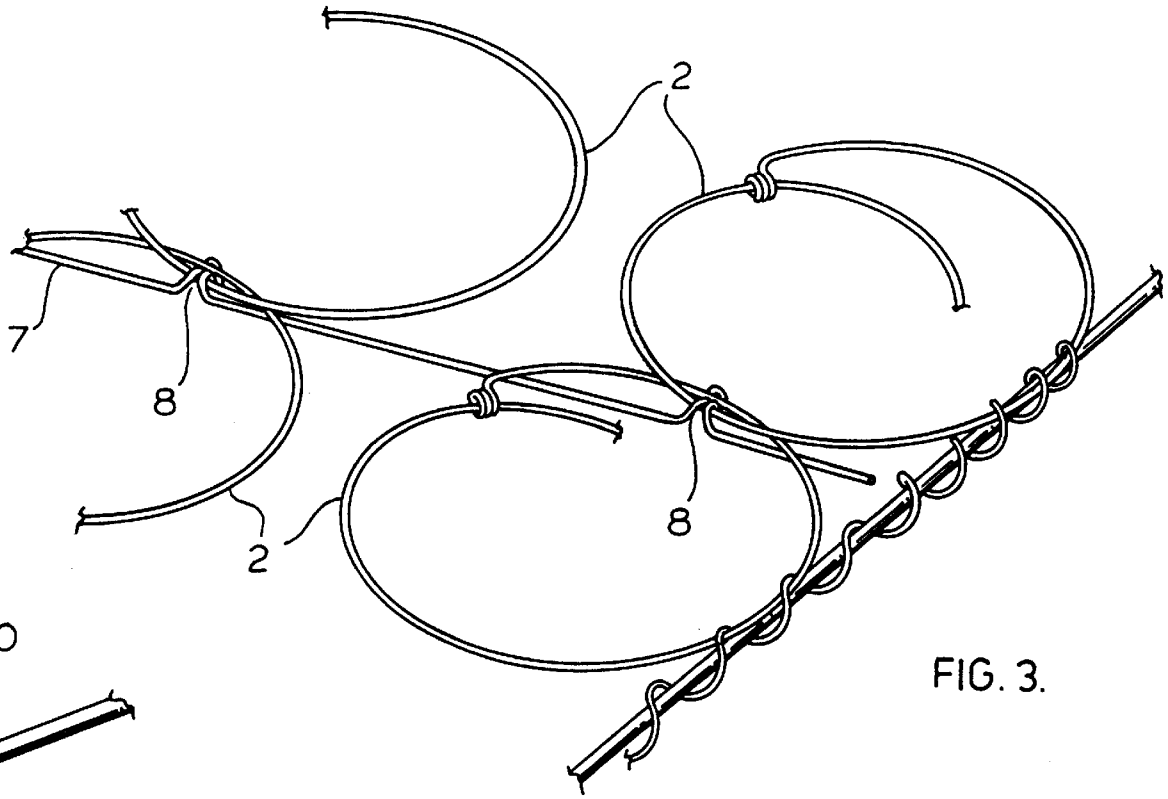
FIG. 3 is a cut away view of the top surface of an inner spring assembly which uses a crimp rod to join adjacent coils.
Figure 4:
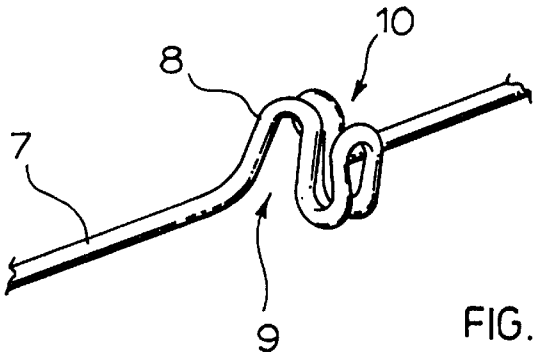
FIG. 4 is a cut away detailed view of a crimp connector on a crimp rod.

As shown in FIGS. 3 and 4, crimp rods are used in some inner spring assemblies in place of pigtails between the coils. A crimp rod 7 has crimp connectors 8 made from multiple folds in the crimp rod wire creating an inner opening 9 and an outer opening 10 used to hold two coils together. Once the coils have been placed in their respective openings, the outer opening 10 is bent closed to lock the coils in place.

The used inner spring assembly of a used mattress is extracted by removing the mattress covering layers therefrom in a conventional manner such as by cutting, tearing and pulling the non metal material from the assembly.

The resulting inner spring assembly is then inspected for suitability for re-use. In many cases, the assembly is undamaged and retains its shape despite years of use and requires no structural repair. In other cases, the inner spring assembly has been subjected to some extreme forces which will have bent the border wire or the connecting wire elements in one or more localized areas away from the assembly's original shape or position. The wire components in said localized areas can be bent by hand or by mechanical means to restore said components to their original shape and positions which improves the mechanical properties of said localized areas as herein described. If the border or connecting wire is actually damaged, it may be replaced, but it is often more efficient to leave the damaged component in place and attach an additional component adjacent to the damaged one. The coils themselves will rarely be bent out of shape in such circumstances resulting in the same inner spring assembly structure as when new. Sometimes, however, a small number of coils will be deformed or even broken, especially if the connecting wire elements are crimp rods and one or more closed openings 10 have loosened and allowed the associated coils to become disconnected. In such cases the deformed or broken coils are removed and either new coils or good quality used coils are inserted in their place and reattached to the surrounding coils and border wire resulting in the same inner spring assembly structure as when new.

Said restored or undamaged inner spring assembly is then heat treated to relieve the stresses in the wire components. The degree of stress relief achieved for the wire components depends on what temperatures they are raised to and the period of time they are maintained at the elevated temperatures. If the temperatures are too low or the durations at those temperatures is too short, little or no stress relief will be achieved. If the temperatures are too high, the wire risks undergoing degradation in its mechanical strength. The degree of stress relief obtained for given temperatures and durations of heat treatment further depends on the chemical composition of the wire, the gage of the wire, and the methodology of the drawing of the wire. However, for the vast majority of inner spring assemblies, the wire components will achieve substantial stress relief without undergoing undesirable physical changes when heated to between about 204 to 288 degrees Celsius (400 and 550 degrees Fahrenheit) for between about ten to twenty minutes.

According to the preferred embodiment, said restored or undamaged inner spring assemblies are vertically positioned on dollies which are wheeled into a conventional batch type gas fired double skin insulated steel oven for heat treatment. Initially said oven has an internal temperature of about 149 degrees Celsius (300 degrees Fahrenheit) which is gradually raised to 288 degrees Celsius (550 degrees Fahrenheit) over a period of about 38 minutes. Said oven is then maintained at 288 degrees Celsius (550 degrees Fahrenheit) for about 17 minutes. The inner spring assemblies are then wheeled out of the oven on their supporting dollies and allowed to cool.

In the preferred embodiment disclosed, the temperature of the oven will drop back to about 149 degrees Celsius (300 degrees Fahrenheit) as a result of having the two winced doors opened to remove a first batch of heat treated inner spring assemblies and to insert a second batch of inner spring assemblies for treatment. Furthermore, the temperature in a conventional oven is not perfectly homogeneous throughout the oven which fact has been taken into account in choosing an oven temperature and duration that will ensure substantial stress relief of all the components of the entire batch of inner spring assemblies receiving heat treatment according to the preferred embodiment. It is therefore understood that substantial stress relief of the inner spring assemblies will be achieved at different temperatures and durations depending on the characteristics of the oven used to effect the heat treatment process.

Said inner spring assemblies which were either undamaged or restored and subjected to the heat treatment process according to the present invention have the same structure as when new but have overall improved load bearing capacity than when new.

After the inner spring assemblies have cooled sufficiently in air, new mattress ticking and padding materials are added thereto in the conventional way as for a new mattress. Each resulting mattress contains both an inner spring assembly that is bettor than when new and a new mattress covering which warrants the sale of the resulting mattress as a new product.

While the invention has been described in particular with reference to mattresses, it will be understood that box springs, cushions or other products containing inner springs similar to mattresses such as inner springs containing cushions fall within the spirit of the invention and scope of the appended claims.

Although various preferred embodiments of the present invention have been described herein in detail, it will be appreciated by those skilled in the art, that variations may be made thereto without departing from the scope of the invention or the scope of the appended claims.

What is claimed is:

1. Process for preparing an inner spring assembly of coil springs, connecting wires and border wires previously used within a mattress for use in a new mattress, comprising the steps of restoring any distorted border or connecting wires back to their proper shape and restoring any displaced inner spring components back to their proper position within said inner spring assembly, and heating said inner spring assembly to a temperature of about 400 and 550 degrees Fahrenheit for about 10 to 20 minutes to sanitize said inner spring assembly and to stress relieve said coil springs, connecting wires and border wires to thereby increase the load bearing capacity of said inner spring assembly.

2. The process according to claim 1 further comprising the step of removing any damaged coils from said inner spring assembly and substituting said damaged coils with replacement coils prior to said heating step.

3. The process according to claim 1 further comprising the step of adding, prior to said heating step, replacement or additional border or connecting wire to said inner spring assembly where such wires are damaged.

4. The process according to claim 2 or claim 3 wherein said heating step comprises the steps of placing said inner spring assembly in an oven with an oven temperature of about 300 degrees Fahrenheit thereafter elevating sad oven temperature gradually to about 550 degrees Fahrenheit over a period of between 30 and 45 minutes, and maintaining said elevated oven temperature for a period of about 17 minutes.

5. The process according to claim 2 or claim 3 further comprising the subsequent steps of allowing said inner spring assembly to cool in air, and attaching covering layers to said inner spring assembly to provide a completed inner spring supported mattress or the like.

6. A process for producing a new improved mattress from a used mattress containing an inner spring assembly of coil springs, connecting wires and border wires, comprising the steps of removing the used mattress covering layers from said inner spring assembly, heating said inner spring assembly to a temperature of about 400 and 550 degrees Fahrenheit for about 10 to 20 minutes to sanitize said inner spring assembly and to stress relieve said coil springs, connecting wires and border wires to thereby increase the load bearing capacity of said inner spring assembly, allowing said inner spring assembly to cool in air, and attaching new mattress covering layers to said inner spring assembly.

7. A process according to claim 6 further comprising the step of restoring any distorted border or connecting wires back to their proper shape and restoring any displaced inner spring components back to their proper position within said inner spring assembly prior to said heating step.

8. A process according to claim 6 further comprising the step of removing any damaged coils from said inner spring assembly and substituting said damaged coils with replacement coils prior to said heating step.

9. A process according to claim 6 further comprising the step of adding, prior to said heating step, replacement or additional border or connecting wire to said inner spring assembly where such wires are damaged.

10. A process according to claim 7, 8 or 9 wherein said heating step comprises the steps of placing said inner spring assembly in an oven with an oven temperature of about 300 degrees Fahrenheit, thereafter elevating said oven temperature gradually to about 550 degrees Fahrenheit over a period of between 30 and 45 minutes, and maintaining said elevated oven temperature for a period of about 17 minutes.

* * * * *